US005158173A

United States Patent [19]

Halsey et al.

[11] Patent Number: 5,158,173

[45] Date of Patent: Oct. 27, 1992

[54] WEAPONS STORAGE CONTAINER TO PREVENT SYMPATHETIC DETONATION OF ADJACENT WEAPONS

[75] Inventors: Carl C. Halsey; Sharon L. Berry, both of Inyokern, Calif.

[73] Assignee: The United States of America as represented by the Secretary of the Navy, Washington, D.C.

[21] Appl. No.: 559,871

[22] Filed: Jul. 27, 1990

[51] Int. Cl.[5] ..... F42B 39/14; F42B 39/24

[52] U.S. Cl. ..... 206/3; 206/584; 206/591; 89/36.02

[58] Field of Search ..... 206/3, 443, 592, 593, 206/594, 584, 588, 591, 814; 89/34, 36.02

[56] References Cited

U.S. PATENT DOCUMENTS

| | | | |
|---|---|---|---|
| 3,757,933 | 9/1973 | Banta | 206/3 |
| 3,828,699 | 8/1974 | Bowen | 89/36.02 X |
| 4,199,057 | 4/1980 | Gruaz | 206/3 |
| 4,222,484 | 9/1980 | Howe | 206/3 |
| 4,248,342 | 2/1981 | King et al. | 89/34 X |
| 4,286,708 | 9/1981 | Porzel | 206/3 |
| 4,440,296 | 4/1984 | Howe et al. | 206/3 |
| 4,566,588 | 1/1986 | Kataczynski | 206/3 |
| 4,666,034 | 6/1987 | Johnson et al. | 206/443 X |
| 4,768,418 | 9/1988 | Blommer et al. | 89/34 |
| 4,833,967 | 5/1989 | Kornhauser | 89/34 |
| 4,850,260 | 7/1989 | Walker et al. | 89/34 |
| 4,878,415 | 11/1989 | Foster, Jr. et al. | 89/34 |

*Primary Examiner*—Paul T. Sewell
*Assistant Examiner*—Jacob K. Ackun, Jr.
*Attorney, Agent, or Firm*—Harvey A. Gilbert; Melvin J. Sliwka; John Forrest, Jr.

[57] ABSTRACT

A material for use in containers for explosive media and a material for use in containers for absorbing the dynamic shock of an explosion and prevent sympathetic detonation of adjacent explosive device in which the material is a relatively lightweight, porous, shock absorbing material mixed with a binder to provide a castable composite. A storage container receives the cast filler and is thereby hindered from being subjected to destruction from sympathetic detonation due to donor detonation within the storage container or a proximate storage container.

5 Claims, 2 Drawing Sheets

WEAPONS STORAGE CONTAINER TO PREVENT SYMPATHETIC DETONATION OF ADJACENT WEAPONS

BACKGROUND OF THE INVENTION

The present invention relates in general to absorbing a dynamic shock of an explosion and pertains, more particularly, to a material for use in containers for explosive media and a material for use in containers for absorbing the dynamic shock of an explosion and prevent sympathetic detonation of adjacent explosive devices. The storage container and filler material of this invention is an improvement over the conventional explosive container.

With the conventional storage and transportation containers for explosive devices, such as grenades, safety is an important factor for the personnel and the storage magazine. The storage of large amounts of conventional munitions in centralized locations poses the possibility of sympathetic detonation and wide spread destruction, injury and possibly loss of life.

It is known that the explosion of one device or round (often referred to as a "donor explosion") among many in storage has the inevitable result of the propagation of a high-order detonation throughout the adjacent explosives, grenades, rounds, and the like and possibly throughout the entire magazine.

There are recognized drawbacks with many conventional materials. Materials such as rubber, plastic, or styrofoam-type are not usable, primarily due to the adverse thermal environment to which they would be subjected. Other possible materials include soils, ceramics, or asbestiform aluminosilicates. This latter material must be ruled out due to potential health hazards related to asbestos products.

Since soils tend to pack too closely they would not be expected to have the desired shock-absorbing properties of a more expanded product such as a ground or crushed rock material. Among the drawbacks associated with ceramics is the complicated procedure that would be expected to be involved in providing for air entrainment in the ceramic in order to produce a closed-cell ceramic foam. Thus, ground or crushed rock and particularly pumice became a preferred material.

Other crushed rock materials were considered, such as volcanic scoria. However, it is known that when scoria is used in a blast test with relatively large munitions it is not an adequate material by virtue of its relative lack of compressibility at relatively smaller particle sizes.

SUMMARY OF THE INVENTION

Accordingly, it is an object of the present invention to provide an improved explosive storage container and dynamic shock absorbing filler material that comprises a unique composite of graded pumice granules bound in a matrix and cast into the container. With the filler material of this invention cast into the storage container of this invention dynamic shock of the explosion of one stored grenade or round is absorbed and sympathetic detonation of the surrounding grenades or rounds is generally prevented.

Another object of the present invention is to provide an improved explosive storage container and dynamic shock absorbing filler material that provides an efficient, safe, and inexpensive storage container with a previously unattained margin of safety in the storage of explosives.

A further object of the present invention is to provide an improved explosive storage container and dynamic shock absorbing filler material that allows construction of a storage containers with different lateral and vertical spacings between the explosive media and thereby optimize the shock absorbing and damping effect for various overall sizes, weights, and capacities of storage containers.

Still another object of the present invention is to provide an improved explosive storage container and dynamic shock absorbing filler material that is readily and easily stacked and transported. The storage container of this invention is of particular use for transporting explosive media, since the transportation of the media is a frequent cause of donor explosions.

Still a further object of the present invention is to provide an improved explosive storage container and dynamic shock absorbing filler material wherein the filler material is preferably a lightweight, porous, shock absorbing material that survives an aggressive thermal environment without burning.

Another object of the present invention is to provide an improved explosive storage container and dynamic shock absorbing filler material having properties simulating those of an air-entrained hardened foam material. The shock absorbing media of the present invention is easily obtained, plentiful, inexpensive, and requires no special equipment or complicated process to function as desired.

A further object of the present invention is to provide an improved explosive storage container and dynamic shock absorbing filler material that has a relatively fine cellular structure and exhibits both the characteristics of shock-dampening and rigidity, the latter also exhibiting a tendency to dampen the propagation of fragments of the exploded donor round.

Still another object of the present invention is to provide an improved explosive storage container and dynamic shock absorbing filler material that is readily stabilized. The filler material of this invention is preferably provided as a composite and castable mixture that is then cast into the storage container and provides receptacles for the explosive rounds.

Still a further object of the present invention is to provide an improved explosive storage container and dynamic shock absorbing filler material that hinders sympathetic detonation of any components or additional rounds within a container or a surrounding container upon the high order detonation of an explosive round within the storage container.

The container and cast filler material of this invention is characterized by the prevention of sympathetic detonation of surrounding rounds upon the high-order detonation of a 40-mm grenade round or its equivalent.

To accomplish the foregoing and other objects of this invention there is provided a material for use in containers for containing explosive media and a material for absorbing the dynamic shock of an explosion and prevent sympathetic detonation of adjacent explosive devices. The material comprises a filler material for damping an explosive shock in a storage container for explosive rounds. The filler means is collapsible and capable of absorbing an explosive shock and is also nonflammable in an aggressive thermal environment.

A binding means allows the filler to cast into a self-supporting shape. In the disclosed embodiment a relatively compressible volcanic material, that is, a pumice is provided with a binder of a casting plaster. A storage container for an explosive round to hinder a sympathetic explosion due to the detonation of a donor round comprises storage means suitable for storing and transporting an explosive round and a filler means for hindering an unwanted sympathetic detonation within the storage container or proximate storage containers.

A method of manufacturing a filler material for use in storage or transportation container for explosive rounds is disclosed that comprises the steps of selecting an appropriate compressible crushed or ground rock mixed with a binder and cast into a storage container.

These and other objects and features of the present invention will be better understood and appreciated from the following detailed description of the following embodiments thereof, selected for purposes of illustration and shown in the accompanying drawing.

BRIEF DESCRIPTION OF THE DRAWINGS

FIG. is a perspective view of a storage container constructed in accordance with the present invention with the lid shown so as to show the explosive media containment and the shock absorbing material cast in place.

DETAILED DESCRIPTION

Figure 1:
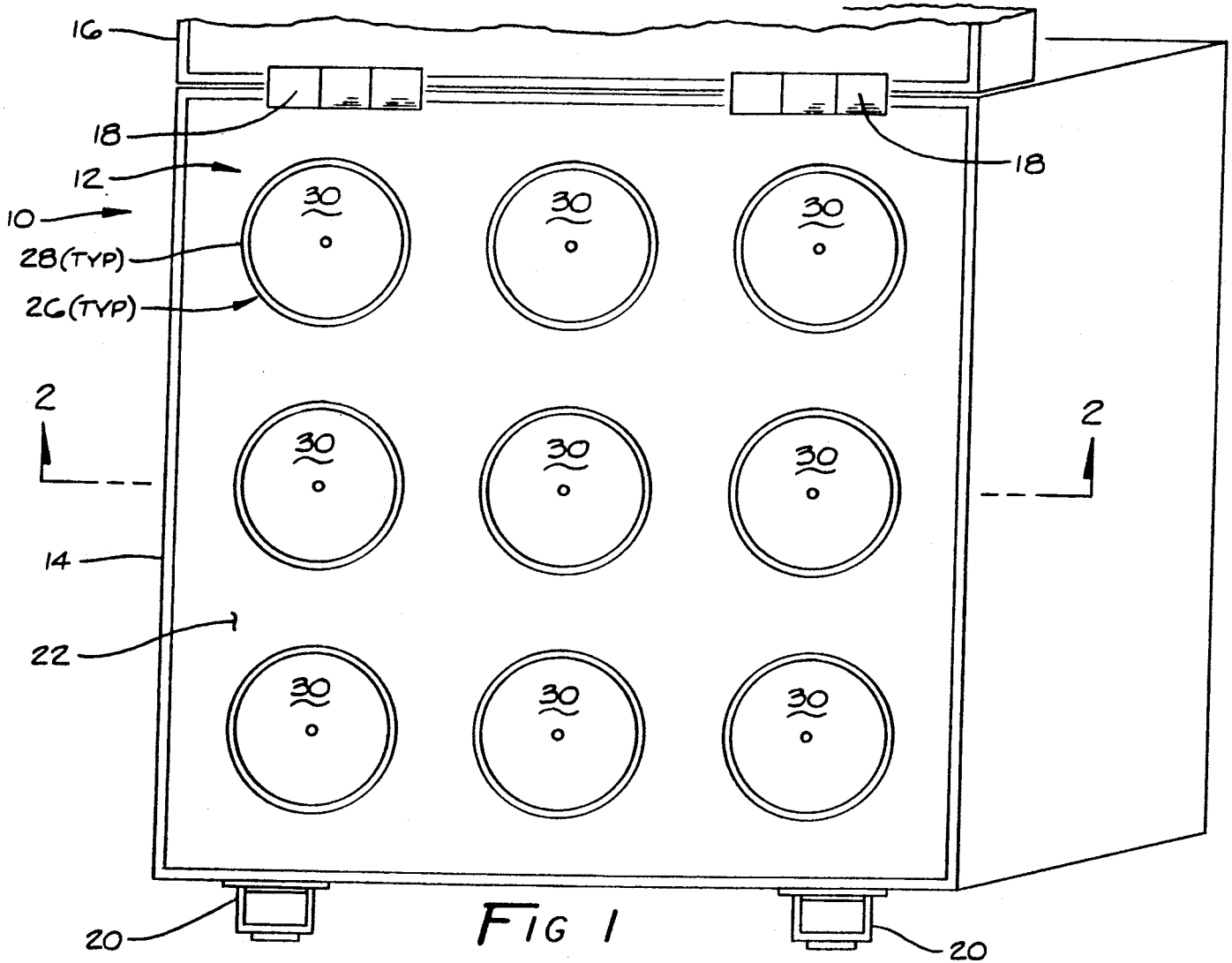

Referring now to the drawings there is shown a preferred embodiment for the storage container and cast-in-place shock dampening material of this invention. The filler material and storage container are described in connection with a 40-MM high explosive dual purpose (HEDP) M433 grenade.

The filler material of the present invention is particularly adapted for providing protection against sympathetic detonation of explosive media or rounds as a result of a detonation of a donor round, and is characterized by a castable mixture suitable for use in a storage and transportation container.

Figure 2:
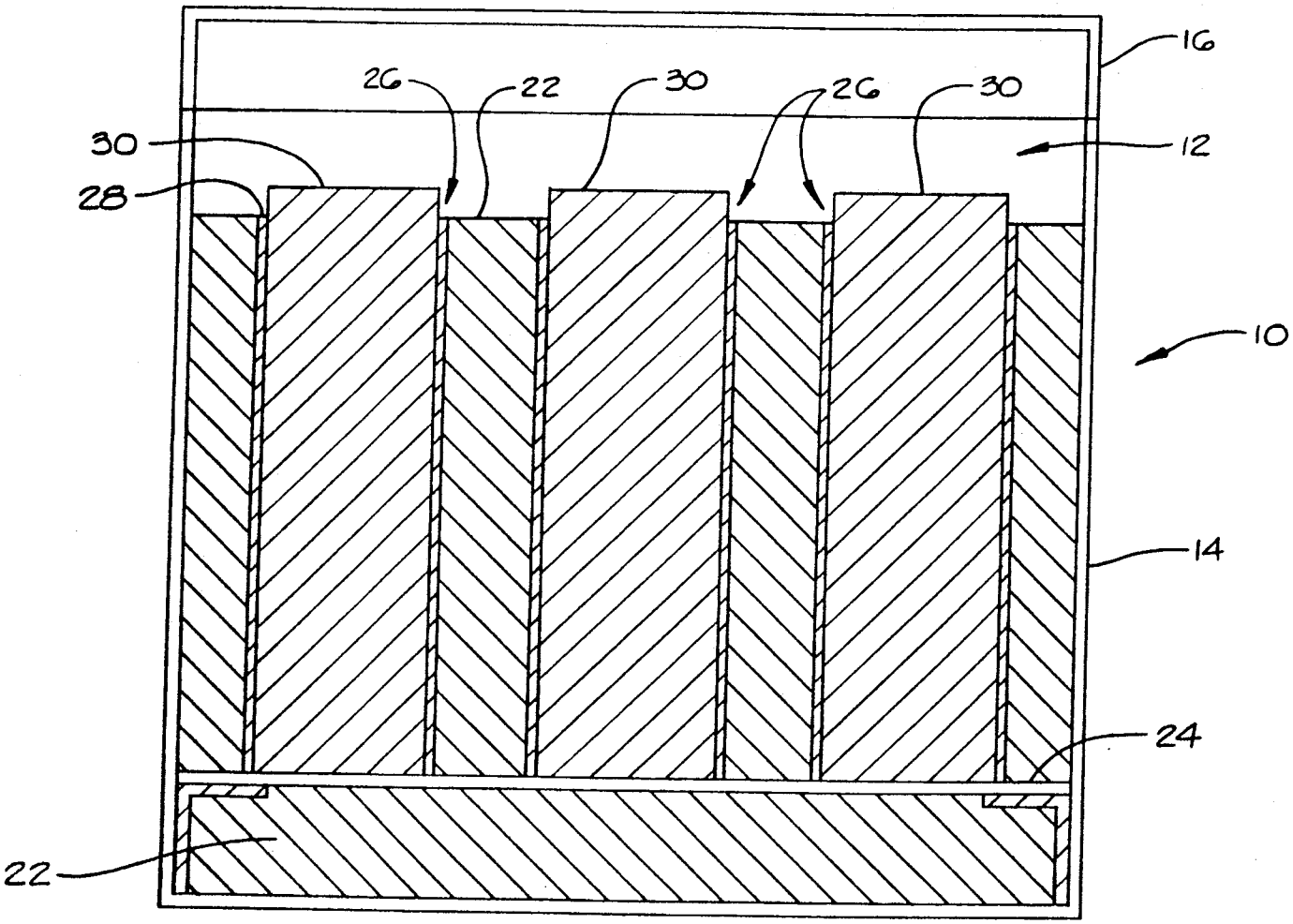
FIG. 2 is a cross-sectional view taken along line 2—2 in FIG. 1.

The drawings, FIGS. 1 and 2, show the storage container 10 in conjunction with an explosive media, round, or grenade 12. In the preferred embodiment a 40-MM high explosive dual purpose (HEDP) M433 grenade and grenade storage container are illustrated and described. Available test results are discussed below and Report NWC TP 2029, "40-MM High Explosive Dual Purpose (HEDP) M433 Grenade Storage Container: Evaluation of Prototype Protective Container", Aug. 1989 (Limited Distribution) is incorporated herein by reference.

The container 10 comprises a storage and transport compartment 14. A conventional container with a lid or cover 16, hinge 18, and fastener 20 is depicted in the drawing figures.

A pumice and casting plaster composite mix 22 of the present invention is cast intermediate a lower support plate 24 and the bottom of the storage container 10. An explosive media receptacle 26 is formed by casting the mix around defining forms 28, for example plastic tubes. Each receptacle 26 may receive an associated explosive media 12.

In a preferred embodiment the explosive is an explosive round, such as a grenade. The dimensions of the storage container are known from the referenced military specification. The dimensions include a top approximately one inch deep for an aluminum storage container approximately one-quarter inch thick. The square configuration of a preferred embodiment has an outside dimension of approximately eight and seven-eights inches and the aluminum lower support plate approximately one inch above the container bottom.

The lower support plate in the depicted embodiment is approximately one-eighth inch thick. The tubes 28 are spaced apart approximately one inch from each other and approximately one-half inch from the inside of the container. The composite is cast approximately three and one-half inches deep and completely fills the void between the tubes 28. The grenade extends approximately one-quarter inch above the cast composite.

The pumice or equivalent ground rock fragments are stabilized in a preferred embodiment in the following manner. It will be understood that a relatively loose material could not maintain a stable position around the explosive round and would probably prove to be too cumbersome to deal with effectively. Binding the filler material allows the filler to maintain its shape with respect to the explosive rounds and can be cast in whatever shape is found desirable.

A binder was chosen therefor which does not significantly alter the physical properties of the ground rock or stone, a volcanic pumice in a preferred embodiment. A casting plaster was chosen as a preferred binding medium.

In operation, in connection with the storage container and identified grenade rounds previously mentioned to prevent sympathetic detonation of acceptor rounds due to the explosion of the donor round, the pumice and casting plaster are placed in a suitable mixing container and initially mixed in their dry state. Water is added to the dry pumice and plaster mix and then mixed until approximately all of the plaster dissolved and the pumice minimally coated.

The mixture is added to the storage container having the receptacle defining tubes in place. The mixture is smoothed into place to minimize the presence of any air voids. In a preferred embodiment the pumice used is a white, porous, glassy material obtained from a mining operation in a western state convenient to the test site. It has been determined that the pumice density ranged from approximately 0.54 to approximately 1.19 grams-per-cubic centimeter.

Screening the pumice provides a particle size range of greater than approximately one-eighth inch and smaller than approximately one-quarter inch. The binder in the preferred embodiment is an off-the-shelf casting plaster with a set-time of approximately twenty minutes.

A preferred embodiment of the present invention was tested in a combination of eight prototype tests and two baseline tests. Evaluation of these tests are reported in NWC TP 2029 and are related in the following section for additional clarification and validation of this invention, if required.

It is believed that evaluation of these tests by those skilled in the art will confirm that a preferred embodiment of a composite of graded pumice granules bound in a matrix of casting plaster and cast into the storage compartment 14 the storage container 10, preferably aluminum, absorbs dynamic shock from detonation of a single stored grenade, the donor detonation. There is no sympathetic detonation either within a container or between containers. This later arrangement is typical of a magazine.

BASELINE TESTS

RATIONALE

Prior to testing the cast pumice media, there had to be some baseline data from which to make comparisons. If, for instance, the 40-mm rounds would not cause sympathetic detonation as currently stored and transported, there would be no reason for the tests. Hence, the first tests were conducted in a conventional fragmentation chamber and included one donor and one or two acceptor rounds (the round that receives the blast and fragmentation from the donor cell) stored in conventional plastic holders.

The donor round for all tests was an M77 40-mm grenade body with the shaped charge filled with 28 g of C-4 for initiation. Standard 40-mm HEDP M433 round were used in the test series as acceptors. The two rounds are similar with respect to the shaped charge shape and size and both are fragmenting rounds.

BASELINE TEST NO. 1

The first test utilized one donor and one acceptor round. The acceptor round detonated, but its shape charge did not function.

BASELINE TEST NO. 2

The second test utilized one donor and two acceptor rounds. As in the first baseline test, both acceptors detonated, but neither shape charge functioned.

The baseline results were clear. The plastic containers were not adequate to stop the sympathetic detonation of proximal 40-mm grenades. It could be expected that a chain reaction could occur in a storage configuration if just one 40-mm round went high order.

GRENADE TESTS WITH GRANULAR PUMICE COMPOSITE

TEST NO. 1

The first test using a preferred cast granular pumice composite of the present invention had one donor and one acceptor round in a three-hole configuration within a cast block that measured 12 inches long by 6 inches wide by 5 inches high. There was one inch of cast pumice between the grenades when stored in the cast block. The donor round occupied an end position in the block, and the acceptor round occupied the central position in the block.

The detonation totally demolished the block, leaving only a few fist-sized pieces of cast pumice and three fragments of the acceptor round, including the shape charge. There was no detonation and no fire from the acceptor.

TEST NO. 2

The second test utilized one donor round and eight acceptor rounds cast in an 3 by 3 grenade configuration in an aluminum container without a lid. The spacing between holes was set with 1.0-inch of cast pumice. The donor round was placed in a central hole of the configuration. Six acceptor rounds were broken by the detonation and two rounds remained intact. Two sides of the aluminum container were blown apart from the remainder of the container. None of the acceptor rounds detonated and there was no fire.

TEST NO. 3

The third test was very similar to the second test, except that a finished aluminum container with a top latched lid was used. The design of the aluminum container comprised one inch of cast pumice between the rounds, plus the plastic tube with walls 0.125-inch thick (darkened area) used for the composite to keep its shape.

A layer of aluminum approximately one inch above the bottom of the container filled with approximately one inch of cast pumice intermediated the aluminum layer and the bottom of the storage container. This design comprises one preferred embodiment and is used in the rest of the tests.

If spacing was changed for an individual test, it will be called out under the test description. The results of the test were very similar to Test No. 2 and particularly seven of the eight acceptors broke and one remained intact. There was no detonation or fire.

TEST NO. 4

The fourth test utilized a double-wide container with 18 grenade receptacles. One donor and 17 acceptors were used, again with one inch of cast pumice between the rounds. The donor round was placed in the middle row, in the second position in from the exterior wall. The detonation blew the lid off of the container (intact) and tore the container into several large pieces. Only four acceptors were broken, all others remained intact.

One of the acceptor rounds was propelled into a protective wire mesh at the top of the conventional fragmentation cell where it separated into two pieces. There was no detonation or fire.

TEST NO. 5

The fifth test was a two-grenade stack test. One grenade was placed over the top of another. The top container was the donor, the bottom was the acceptor. There was no detonation or fire from the acceptor, which was broken. A slug of the donor penetrated to the bottom of the acceptor container, but did not go through it.

The donor detonation did facilitate the breakup of the acceptor round, but did not detonate that round. Moreover, the shaped charge of the donor was diverted by the lower plate of the donor container and the upper plate of the underlying acceptor container such that it did not hit the acceptor round head-on. The results were an unsuccessful detonation of the acceptor round.

It seems as though the aluminum plates of the containers and their sandwich geometry act effectively in diverting a shaped charge jet.

TEST NO. 6

The sixth test comprised one donor and seven acceptors with 0.5-inch of cast pumice between rounds. The donor container was the central position of a 3 by 3 grenade grid, and a corner position was vacant. All seven acceptors broke in this test. The four acceptors around the donor were severely damaged and parts of the components burned including two primers that had reacted. Portions of the explosive train from an acceptor fuze reacted, however, there was no apparent damage to the explosive charge.

In retrospect, the 1-inch spacing seemed more adequate.

TEST NO. 7

The seventh test comprised a donor and 15 acceptors with one inch of cast pumice between rounds. The container for this test was a standard issue aluminum container Mk 387 Mod 0, Stock Number 8140-00-497-3636. The dimensions of the usable inside space was 11.75- by 14.13- by 5.86- inches. The container lid was closed prior to firing.

Four acceptors were broken and eleven were undamaged. There was no detonation or fire from the acceptors.

TEST NO 8

The eighth test comprised a donor and 19 acceptors with 0.75 inch of cast pumice between rounds. The container for the test was a standard issue aluminum container. The donor detonated, breaking eight acceptors. Eleven of the acceptors were intact and undamaged. Out of the eight that were broken up, it appears that in one the powder totally burned and the fuze components reacted, in two others the fuze components reacted, and the other five showed severe damage, but no burn.

From the foregoing description those skilled in the art will appreciate that all of the objects of the present invention are realized. A storage container and associated filler material have been shown and described for providing the desired dampening of sympathetic detonations due to a donor detonation in the storage container or a proximate storage container. An improved explosive storage container and dynamic shock absorbing filler material combination provides a unique composite of graded pumice granules bound in a matrix and cast into the container.

The storage container and dynamic shock absorbing filler material provide an efficient, safe, and inexpensive storage container with a previously unattained margin of safety in the storage of explosives. The storage containers may be constructed with any one of a number of different lateral and vertical spacings between the explosive media and thereby optimize the shock absorbing and damping effect for various overall sizes, weights, and capacities of storage containers. The storage containers are readily and easily stacked and transported.

The disclosed filler material and composite have properties simulating those of an air-entrained hardened foam material. The cast composite has a relatively fine cellular structure and exhibits both the desired characteristics of shock-dampening and rigidity, the latter also exhibiting a tendency to dampen the propagation of fragments of the exploded donor round. A preferred filler material is readily stabilized in combination with a casting plaster.

While specific embodiments have been shown and described, many variations are possible. The particular shape of the storage container including all dimensions may be changed to suit a particular explosive round. The housing materials may vary although aluminum is preferred for its strength and light weight. The configuration and number of receptacles may vary although a nine-by-nine configuration is particularly suitable for the grenade tested.

The shock absorbent material and the binder may vary if equivalent substitutes are found during additional testing in the fragmentation chamber and in the field.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A storage container for an explosive round to hinder a sympathetic explosion due to the detonation of a donor round, comprising:

storage means suitable for storing and transporting an explosive round, the storage means including a storage or transportation compartment;

means disposed in said storage means for receiving an explosive round and defining a volume for receiving the explosive round;

ground or crushed compressible pumice for hindering the unwanted sympathetic detonation, said pumice received within the storage means except in the volume defined as the explosive round receiving means; and means for binding said pumice into a self-supporting shape between and about each round and any adjacent round and any round and an adjacent wall of said storage container.

2. A storage container as set forth in claim 1 wherein the pumice particle size ranges from between approximately one-eighth inch and approximately one-quarter inch, inclusive.

3. A storage container as set forth in claim 1 wherein the pumice particles have a density ranging from between approximately 0.54 grams-per-cubic centimeter and approximately 1.19 grams-per-cubic centimeter.

4. A storage container as set forth in claim 1 wherein the binding means comprises a casting plaster having a set time of approximately twenty minutes.

5. A storage container as set forth in claim 1 wherein the storage means further comprises a lower support plate constituting a floor spaced above and in parallel with the bottom of the container and generally supporting the explosive round within the storage means and said pumice and means for binding said pumice substantially fills a void intermediate the lower explosive round support plate and the bottom of the storage container.

* * * * *